US011635172B2

(12) United States Patent
Pereira et al.

(10) Patent No.: US 11,635,172 B2
(45) Date of Patent: Apr. 25, 2023

(54) LIGHT BULB WITH CRYSTAL MODIFIER

(71) Applicants: Fred Metsch Pereira, Amsterdam (NL); Tycho Olivier van Iwaarden, Amsterdam (NL)

(72) Inventors: Fred Metsch Pereira, Amsterdam (NL); Tycho Olivier van Iwaarden, Amsterdam (NL)

( * ) Notice: Subject to any disclaimer, the term of this patent is extended or adjusted under 35 U.S.C. 154(b) by 0 days.

(21) Appl. No.: 17/454,059

(22) Filed: Nov. 8, 2021

(65) Prior Publication Data

US 2022/0136659 A1 May 5, 2022

Related U.S. Application Data

(63) Continuation-in-part of application No. PCT/US2020/032258, filed on May 8, 2020.

(60) Provisional application No. 62/844,764, filed on May 8, 2019.

(51) Int. Cl.

| | |
|---|---|
| ***F21K 9/69*** | (2016.01) |
| ***F21K 9/232*** | (2016.01) |
| ***F21K 9/60*** | (2016.01) |
| ***F21V 3/06*** | (2018.01) |
| *F21Y 115/10* | (2016.01) |

(52) U.S. Cl.

CPC ..... *F21K 9/232* (2016.08); *F21K 9/60* (2016.08); *F21V 3/06* (2018.02); *F21Y 2115/10* (2016.08)

(58) Field of Classification Search

CPC ... F21K 9/232; F21K 9/61; F21K 9/66; F21K 9/69

See application file for complete search history.

(56) References Cited

U.S. PATENT DOCUMENTS

| | | | | |
|---|---|---|---|---|
| 2,063,153 | A * | 12/1936 | Dittman | H01R 33/00 362/121 |
| 7,588,351 | B2 * | 9/2009 | Meyer | F21V 29/00 362/650 |
| 8,128,262 | B2 * | 3/2012 | Ramer | F21V 29/74 362/322 |
| 8,482,186 | B2 * | 7/2013 | Wang | F21K 9/232 362/558 |
| 8,628,220 | B2 * | 1/2014 | Boonekamp | G02B 6/0008 362/249.02 |
| 8,779,661 | B2 * | 7/2014 | Bain Smith | F21K 9/232 315/50 |
| 9,383,074 | B2 * | 7/2016 | Kadoriku | F21V 3/02 |
| 9,702,510 | B2 * | 7/2017 | Anderson | F21V 19/003 |
| 10,634,310 | B2 * | 4/2020 | Haskal | F21K 9/23 |
| 11,221,108 | B2 * | 1/2022 | Huang | F21K 9/232 |

(Continued)

*Primary Examiner* — Ismael Negron

(74) *Attorney, Agent, or Firm* — Umair A. Qadeer

(57) ABSTRACT

A light bulb assembly that includes a crystal modifier, a housing, a mechanical attachment, a light source, electrical components, and a threaded insert is disclosed herein. The crystal modifier is secured to the housing using a mechanical attachment such as a clamp, clip, spring, shim, thread, or ring. The light source and electrical components are provided in the housing, where the light source is positioned to project light into the crystal modifier. The threaded insert is attached to the housing opposite the crystal modifier and is configured to provide the electrical components and light source with a connection to a power source when the threaded insert is in electrical contact with the power source.

10 Claims, 2 Drawing Sheets

(56) References Cited

U.S. PATENT DOCUMENTS

| | | | | |
|---|---|---|---|---|
| 2012/0218756 | A1* | 8/2012 | Bertram | F21K 9/60 362/249.02 |
| 2013/0223061 | A1* | 8/2013 | Hwu | F21V 29/74 362/294 |
| 2014/0043815 | A1* | 2/2014 | Chuang | F21K 9/232 362/249.02 |

* cited by examiner

LIGHT BULB WITH CRYSTAL MODIFIER

CROSS-REFERENCE TO RELATED APPLICATIONS

This application is a continuation-in-part of PCT Patent Application No. PCT/US2020/032258, filed on May 8, 2020, which claims the benefit of and priority to U.S. Provisional Patent Application. Serial No. 62/844,764, filed on May 8, 2019, the entireties of which are hereby incorporated herein by reference.

BACKGROUND

Field of the Invention

The present disclosure relates to a light bulb with an illuminated crystal.

Description of the Related Art

Decorative lighting typically uses a glass light bulb enclosed or semi-enclosed in a fixture that provides the desired decorative effect. Among the desired decorative effects is illumination of a crystal, where light passes through the crystal and is affected by the properties thereof. Light passing through a crystal will be refracted. The properties of the observed refracted light will depend on the properties of the crystal, including the type of material, crystal structure, thickness, presence of impurities, and other factors.

U.S. Pat. No. 2,063,153 discloses attaching an array of cut glass to a light bulb using glue or a wire through a hole in the glass to provide the electrical connection needed to provide power to the light bulb. PCT Patent Application Publication No. WO 2003/047315A1 discloses a mineral block lamp with a light glued inside a translucent crystal mineral. U.S. Design Pat. No. D426,901 discloses a crystal lamp bulb that uses cut glass as an ornamental feature. U.S. Patent Application Publication No. 2012/0262910 discloses a lamp with a plurality of light sources that are refracted through a crystal. Chinese Patent Application Nos, 204062598, 202101090, 102330945, and 104089244 disclose various LED-based lamps and light bulbs. U.S. Pat. No. 5,414,606 discloses a mirrored light fixture. U.S. Patent Application Publication No. 2012/0257391 discloses a crystal light display holder. Chinese Patent Application No. 201391800 discloses a flower-shaped mineral lamp. Chinese Patent Application Nos. 205716612 and 202165845 disclose the use of mineral blocks in a container with a light bulb.

These and other prior art lamps and lighting fixtures rely on the use of an adhesive such as a glue or a hole to insert a light source into glass or a crystal. A significant problem with using an adhesive such as a glue is that it will be heated whenever the lighting fixture is in use, and thus the adhesive may degrade over time and lose mechanical strength or release undesirable byproducts.

Creating a hole in a crystal also has significant drawbacks. First, creating a hole may damage the crystal that may render the lighting fixture unsafe, especially where the crystal is secured to the light fixture using a component inserted into the hole. Internal fractures in the crystal may not always be visible, and yet may nonetheless significantly mechanically weaken the crystal. Second, a hole will block light, thereby decreasing the total amount of light refracted through the crystal. As a result, a lighting fixture will require a greater amount of power to achieve the same luminosity as a lighting fixture without a hole. This increased power requirement is typically significant. Third, a hole complicates manufacturing. The damage caused by a hole leads to a much higher failure rate during production.

Thus there remains an unmet need for a light bulb that illuminates a crystal without use of a hole or an adhesive to secure the light bulb to the crystal.

SUMMARY

A light bulb assembly that illuminates a crystal, where the crystal is mechanically secured without the use of an adhesive or a hole created within the crystal, is disclosed herein. The crystal has a base and a main body, where the diameter of the main body is larger than the diameter of the base at the interface between the base and main body. The crystal may be secured within the light bulb assembly using a mechanical attachment such as a clamp, clip, spring, shim, thread, ring, or other suitable mechanical attachment that attaches to the base of the crystal. The crystal may preferably be secured within the light bulb assembly using a mechanical attachment that provides sufficient compression to secure the crystal. The base of the crystal may preferably be secured within a light bulb housing. A light bulb cap may be positioned between the base of the crystal and the main body of the crystal. The mechanical attachment may preferably remain secure when heated by the light source of the light bulb assembly when in use.

DETAILED DESCRIPTION OF THE ILLUSTRATED EMBODIMENTS

A light bulb assembly that illuminates a crystal, where the crystal is mechanically secured without the use of an adhesive or a hole created within the crystal, is disclosed herein. The crystal has a base and a main body, where the diameter of the main body is larger than the diameter of the base at the interface between the base and main body. The crystal may be secured within the light bulb assembly using a mechanical attachment such as a clamp, clip, spring, shim, thread, ring, or other suitable mechanical attachment that attaches to the base of the crystal. The crystal may preferably be secured within the light bulb assembly using a mechanical attachment that provides sufficient compression to secure the crystal. The base of the crystal may preferably be secured within a light bulb housing. A light bulb cap may be positioned between the base of the crystal and the main body of the crystal. The mechanical attachment may preferably remain secure when heated by the light source of the light bulb assembly when in use.

As used herein, the tem crystal refers to a single piece of a crystalline solid material, except where explicitly specified otherwise. The term crystal includes, but is not limited to, macrocrystalline, microcrystalline, cryptocrystalline, and nanocrystalline materials, twinned crystals, single crystals, and other crystalline solid materials.

The crystal may preferably be any crystal suitable for illumination, such as a translucent crystal. More preferably, the crystal may be selected from the group consisting of selenite, satin spar, gypsum, quartz, rose quartz, sinhalite, orthoclase, phenakite, phosphophyllite, petalite, euclase, hauyne, chrysoberyl, taaffeite, datolite, topaz, diamond, tourmaline, tugtupite, lazulite, howlite, spessartine, vesuvianite, enstatite, hambergite, titanite, oligoclase, celestine, spodumene, sphalerite, chalcedony, scapolite, danburite, sapphire, moonstone, carnelian, dioptase, dumortierite, cassiterite, pyrope, peridot, calcite, cerussite, heliodor beryl, citrine, kornerupine, iolite, unarovite, zircon, epidote, kyanite, hessonite, scheelite, staurolite, hematite, sillimanite, dravite, spinel, sodalite, fluorite, tektites, diopside, emerald, grossular garnet, zoisite, and microcline. Even more preferably, the crystal may be selenite.

In some embodiments, the crystal may have fiberoptic properties.

The crystal may be shaped or carved into a desired form prior to attachment to the light bulb assembly.

The crystal may optionally be colored using a dye, heat, or other method of imparting color. Such methods are well-known in the art.

Figure 1:
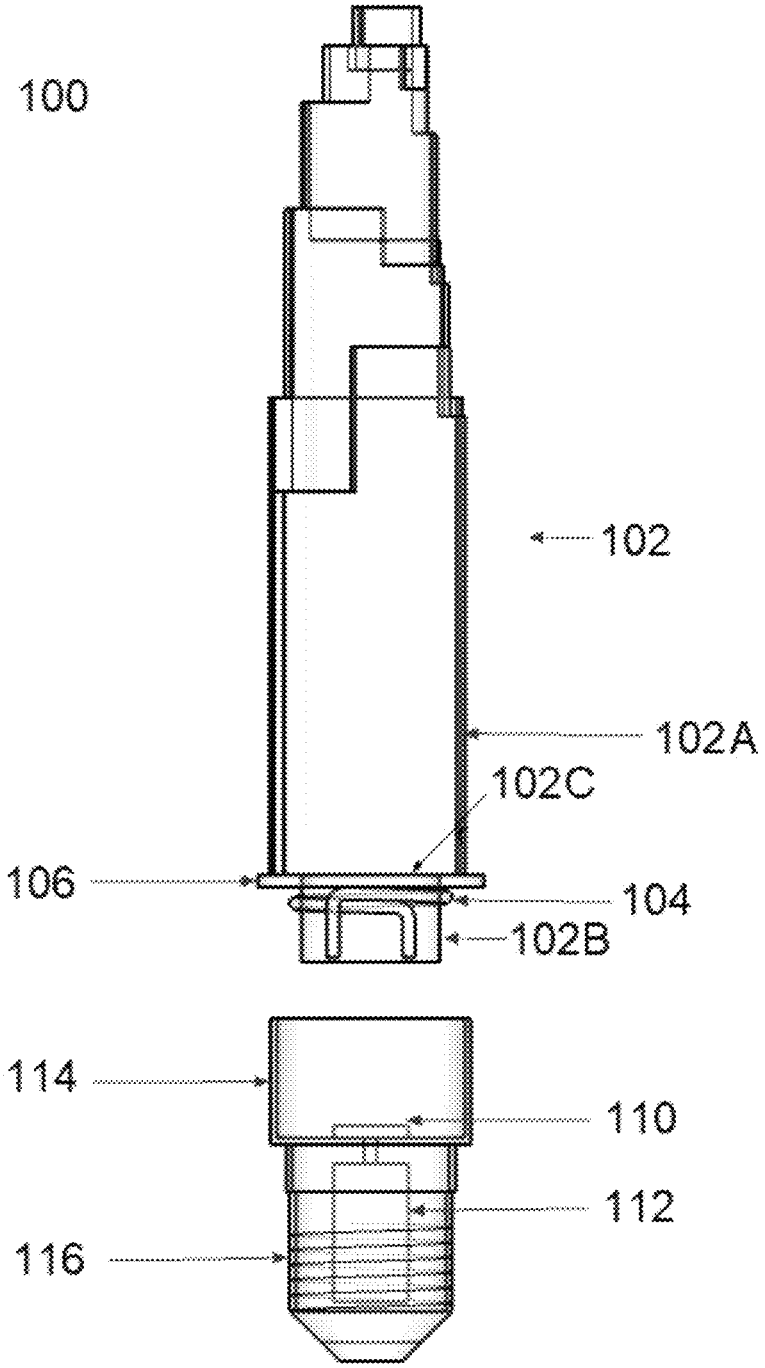
FIG. 1 shows a separated embodiment of the disclosed light bulb assembly.

FIG. 1 shows a separated embodiment 100 of the disclosed light bulb assembly, including a crystal 102 that includes a main body 102A, a base 102B, and an interface 102C between the main body and base, a spring clip 104, a light bulb cap 106, a light source 110, electrical components 112, a light bulb housing 114, and a threaded insert 116. A spring clip 104 mechanically secures the crystal 102 to the light bulb housing 114. The crystal 102 is shaped to fit securely into the light bulb cap 106 without a significant gap that would cause the crystal 102 to wobble appreciably within the light bulb assembly. The light bulb cap 106 attaches to the light bulb housing 114, thereby obscuring the spring clip 104 from view. The threaded insert 116 is a standard threaded insert that may be used to secure the light bulb assembly into a lighting fixture (not shown).

Figure 2:
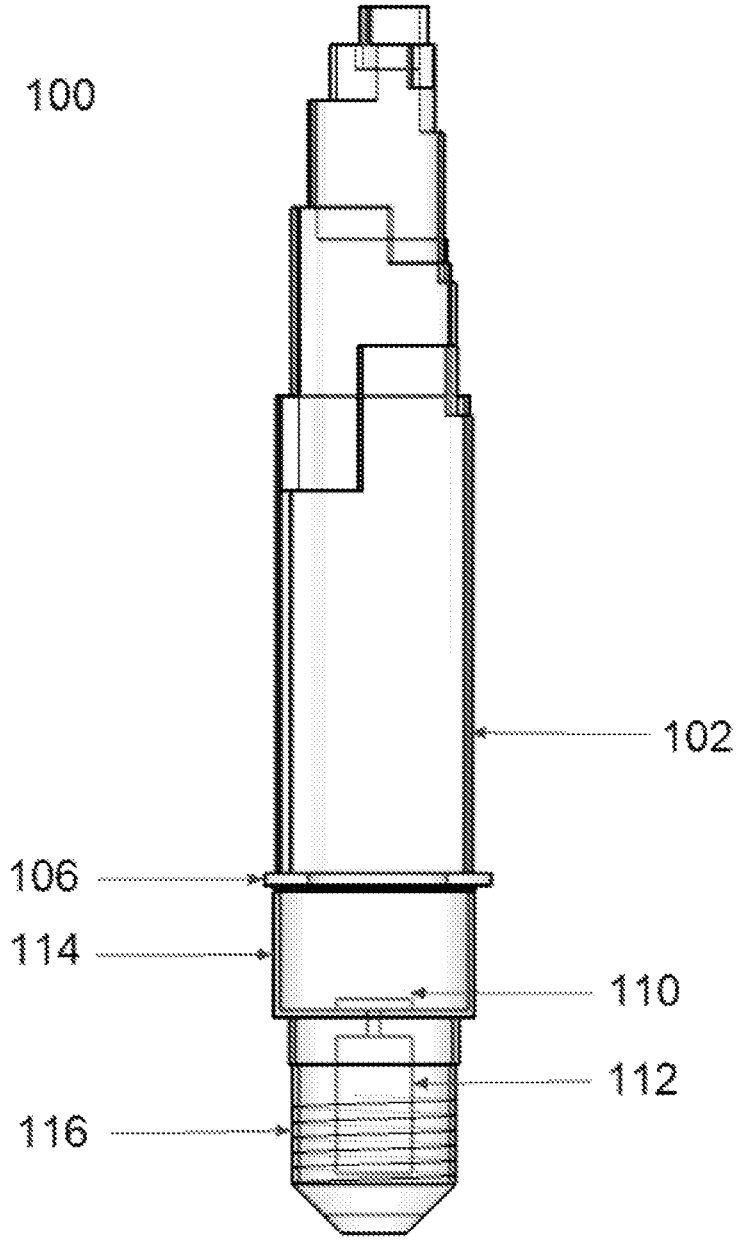
FIG. 2 shows the embodiment of FIG. 1 with the light bulb cap attached to the light bulb housing.

FIG. 2 shows the embodiment of FIG. 1 with the light bulb cap attached to the light bulb housing. The crystal 102 is secured in the light bulb cap 106 and the light bulb housing 114. The light bulb cap 106 is attached to the light bulb housing 114, thereby obscuring the spring clip from view. The threaded insert 116 is used to secure the light bulb assembly into a lighting fixture. The light source 110 and electrical components 112 are configured to effect illumination of the crystal 102 when the embodiment 100 is secured in a lighting fixture (not shown) and the lighting fixture is turned on.

The diameter of the main body of the crystal is larger than the diameter of the base of the crystal at the interface between the base and main body of the crystal.

In some preferred embodiments, the interface is an interior part of the crystal where the base transitions into the main body. The base and main body of the crystal are formed when a crystal is processed, such as by carving or other mechanical processing, to achieve the desired shape for use in the disclosed light bulb assembly. In such embodiments, the base and the main body are preferably part of the same crystal, and thus the interface is simply the interior part of the crystal where the base and main body intersect. Thus, the interface is a plane or a distorted plane within the crystal and does not have any depth. The base and main body are composed of the same material and are delineated only by the shape of the exterior of the crystal, and there is no internal macroscopic difference between the base and the main body at the interface with respect to the material of which the base and main body are composed.

In some alternate embodiments, the base and main body may be two separate crystals that are assembled into the crystal used in the light bulb assembly.

The interface between the base and main body of the crystal is preferably substantially planar.

The base of the crystal may preferably be substantially cylindrical.

The spring clip may preferably be a metal spring clip. The spring clip may preferably be configured to secure the crystal tightly at ambient temperature and at an elevated temperature, where the elevated temperature is a temperature that is ordinarily achieved when the spring clip and crystal are heated by the light source when the light bulb assembly is in use.

In some preferred embodiments, the base of the crystal may include a groove or notch to facilitate securing of the spring clip.

The light bulb cap may preferably be composed of a metal. The spring clip may be secured to light bulb cap by mechanical tension. The spring clip and light bulb cap may be composed of the same material or may alternatively be composed of different materials that have sufficiently similar expansion properties when heated such that the spring clip remains secured to the light bulb cap when heated by the light source.

In some embodiments, the light bulb cap obscures the spring clip from view when the light bulb assembly is fully assembled.

In some preferred embodiments, the diameter of the circle approximated by the curvature of the spring clip may be less than the diameter of the base of the crystal that will be seated thereinto, such that the spring clip secures the crystal tightly at an elevated temperature, where the elevated temperature is a temperature that is ordinarily achieved when the spring clip and crystal are heated by the light source when the light bulb assembly is in use. The preferred ratio of the diameter of the circle approximated by the curvature of the spring clip to the diameter of the base of the crystal that will be seated thereinto may depend on one or more factors such as the spring design, the thickness and profile of the spring wire, whether the spring clip is cold forged or hot forged, or other parameters.

In some embodiments, the light bulb housing is textured. The texture may preferably be ribbing. The ribbing may increase the surface area of the light bulb housing to assist in cooling of the light bulb assembly when in use. The ribbing may also enhance the aesthetic appeal of the light bulb assembly.

In some embodiments, the electrical components of the light bulb assembly may include programmable electronic components that make the light bulb assembly a smart light bulb. Examples of programmable electronic components that may be used in the disclosed light bulb assembly include, but are not limited to, electronic components that allow wireless communication between the light bulb assembly and an external control program such as a smart phone application or other computer program, electronic components that allow real-time color changes to the light, electronic components that allow the light bulb assembly to be turned on or off remotely, electronic components that allow combinations and sub-combinations of these features, and electronic components that allow implementation of other known features of smart light bulbs.

The following example is provided as a specific illustration. It should be understood, however, that the invention is not limited to the specific details set forth in the example.

Further, any range of numbers recited above or in the paragraphs hereinafter describing or claiming various aspects of the invention, such as ranges that represent a particular set of properties, units of measure, conditions, physical states, or percentages, is intended to literally incorporate expressly herein by reference or otherwise any number falling within such range, including any subset of numbers or ranges subsumed within any range so recited. The term "about" when used as a modifier for or in conjunction with a variable is intended to convey that the numbers and ranges disclosed herein may be flexible as understood by ordinarily skilled artisans.

EXAMPLE

An 18 mm spring clip (Taotong Tools) is used to secure a selenite crystal with a base having a diameter of about 20 mm. The crystal is housed in an LED light bulb housing (AIDSSCL E27 COB LED bulb). The crystal remains securely held by the spring clip upon illumination of the light source of the light bulb housing, even after at least about 24 hours of illumination.

The previous description of the disclosed embodiments is provided to enable any person skilled in the art to make or use the invention disclosed herein. Although the various inventive aspects are disclosed in the context of certain illustrated embodiments, implementations, and examples, it should be understood by those skilled in the art that the invention extends beyond the specifically disclosed embodiments to other alternative embodiments and/or uses of the invention and obvious modifications and equivalents thereof. In addition, while a number of variations of various inventive aspects have been shown and described in detail, other modifications that are within their scope will be readily apparent to those skilled in the art based upon reviewing this disclosure. It should be also understood that the scope of this disclosure includes the various combinations or sub-combinations of the specific features and aspects of the embodiments disclosed herein, such that the various features, modes of implementation, and aspects of the disclosed subject matter may be combined with or substituted for one another. The generic principles defined herein may be applied to other embodiments without departing from the spirit or scope of the disclosure. Thus, the present disclosure is not intended to be limited to the embodiments shown herein but is to be accorded the widest scope consistent with the principles and novel features disclosed herein.

Similarly, the disclosure is not to be interpreted as reflecting an intent that any claim set forth below requires more features than are expressly recited in that claim. Rather, as the following claims reflect, inventive aspects may reside in a combination of fewer than all features of any single foregoing disclosed embodiment.

Each of the foregoing and various aspects, together with those set forth in the claims and summarized above or otherwise disclosed herein, including the figures, may be combined without limitation to form claims for a device, apparatus, system, method of manufacture, and/or method of use.

All references cited herein are hereby expressly incorporated by reference.

What is claimed is:

1. A light bulb assembly comprising:

a. a crystal comprising a base, a main body, and an interface between the base and the mains body;

b. a spring clip;

c. a light bulb cap;

d. a light bulb housing; and e. a light source;

wherein the spring clip secures the base of the crystal within the bah bulb housing using compression and without the use of an adhesive or a hole created within the crystal, wherein the diameter of the base of the crystal at the interface is less than the diameter of the main body of the crystal at the interface, wherein the light bulb cap is positioned between the base of the crystal and the main body of the crystal, and wherein the spring clip is configured to remain secure when heated by the light source when the light bulb assembly is in use.

2. The light bulb assembly of claim 1, wherein the spring clip comprises a metal.

3. The light bulb assembly of claim 1, wherein the crystal exhibits fiberoptic properties.

4. The light bulb assembly of claim 1, wherein the crystal is selected from the group consisting of selenite, satin spar, gypsum, quartz, rose quartz, sinhalite, orthoclase, phenakite, phosphophyllite, petalite, euclase, hauyne, chrysoberyl, taaffeite, datolite, topaz, diamond, tourmaline, tugtupite, lazulite, howlite, spessartine, vesuvianite, enstatite, hambergite, titanite, oligoclase, celestine, spodumene, sphalerite, chalcedony, scapolite, danburite, sapphire, moonstone, carnelian, dioptase, dumortierite, cassiterite, pyrope, peridot, calcite, cerussite, heliodor beryl, citrine, kornerupine, iolite, unarovite, zircon, epidote, kyanite, hessonite, scheelite staurolite, hematite, sillimanite, dravite, spinel, sodalite, fluorite, tektites, diopside, emerald, grossular garnet, zoisite, and microcline.

5. The light bulb assembly of claim 4, wherein the spring clip and light bulb cap comprise the same material.

6. The light bulb assembly of claim 4, wherein the spring clip and light bulb cap comprise different materials that have sufficiently similar expansion properties when heated such that the spring clip remains secured to the light bulb cap when heated by the light source.

7. The light bulb assembly of claim 4, wherein the crystal is selenite.

8. The light bulb assembly of claim 4, wherein the diameter of a circle approximated by the curvature of the spring clip is less than a diameter of the base of the crystal.

9. The light bulb assembly of claim 8, wherein the light bulb cap obscures the spring clip from view when the light bulb assembly is fully assembled, and wherein the light bulb housing is textured.

10. The light bulb assembly of claim 9, wherein the texture is ribbing.

* * * * *